US005207445A

United States Patent [19]

Hoelzl

[11] Patent Number: 5,207,445

[45] Date of Patent: May 4, 1993

[54] SHOCK ABSORBER SECUREMENT FOR A SKI BINDING

[75] Inventor: Klaus Hoelzl, Vienna, Austria

[73] Assignee: HTM Sport- und Freizeitgeraete Gesellschaft m.b.H., Schwechat, Austria

[21] Appl. No.: 776,327

[22] PCT Filed: Mar. 16, 1991

[86] PCT No.: PCT/EP91/00504

§ 371 Date: Dec. 11, 1991

§ 102(e) Date: Dec. 11, 1991

[87] PCT Pub. No.: WO91/16112

PCT Pub. Date: Oct. 31, 1991

[30] Foreign Application Priority Data

Apr. 12, 1990 [AT] Austria ..... 884/90

[51] Int. Cl.[5] ..... A63C 5/04

[52] U.S. Cl. ..... 280/607; 280/617; 280/636; 411/178

[58] Field of Search ..... 280/610, 601, 607, 633, 280/636, 617; 411/178, 179, 180

[56] References Cited

U.S. PATENT DOCUMENTS 4,097,061 6/1978 Dietlein ..... 280/607

5,016,901 5/1991 Mayr ..... 280/610

FOREIGN PATENT DOCUMENTS 3705507 9/1987 Fed. Rep. of Germany ..... 280/601

*Primary Examiner*—David M. Mitchell

*Attorney, Agent, or Firm*—Flynn, Thiel, Boutell & Tanis

[57] ABSTRACT

The invention relates to a shock absorber for fastening of ski bindings to a ski (1) having an upper belt (3).

Such shock absorbers are already known in the form of multi-layered strip-like inserts. A disadvantage of this known design is, since the strip-like inserts must be built in during the manufacture of the ski, an adjustment to different hole arrangements of ski binding parts.

The goal of the invention is to enable an individual adjustment for shock absorbers of this type even when the ski has already been manufactured and for many different hole arrangements of ski binding parts.

The set purpose is attained according to the invention by the insert (9, 10, 11) being stored in a sleeve (7), which in turn is inserted into a bore (6) of the ski (1) and is screwed into said bore (6). Each fastening screw is thereby constructed as a metal screw (12), which can with its thread be screwed to the high strength layer (11).

22 Claims, 3 Drawing Sheets

SHOCK ABSORBER SECUREMENT FOR A SKI BINDING

FIELD OF THE INVENTION

The invention relates to a shock absorber for the fastening of ski bindings to a ski having an upper belt, with the ski binding having a base or rather binding plate with receiving points for fastening screws, and with at least one insert receiving and anchoring the screws being provided in a recess in the core of the ski, which insert is constructed of at least one layer of a high strength material, as for example of a metal layer, preferably of an aluminum alloy and/or of GFK-texture laminates, with each insert, aside from the high strength layer, having at least one layer of an elastomer material, like rubber, silicon rubber or the like, preferably arranged above the high strength layer, and with at least one spacer sleeve being provided, which is supported on the high strength layer and extends through the layer of elastomer material and the upper belt, at least the latter one with clearance, and the spacer sleeve, when the binding is mounted, projecting upwardly beyond the upper side of the ski and holding the ski binding, in particular its base or binding plate, at a distance from the upper side of the ski.

BACKGROUND OF THE INVENTION

A shock absorber for ski findings has been accessible to the general public since the ISPO '89 through products, catalogues and illustrative discussions. The inserts, which are used to receive the fastening screws, are in this known design constructed in the core of the ski in the form of multi-layer strips so that front and rear fastening screws, which are each provided on one side of a ski binding part, can each be received by means of an insert. Even if the design has advantageous shock absorbing characteristics, tolerance problems occur from case to case because the strip-shaped inserts must be installed during the manufacture of the ski so that with differently wide skis and with ski binding parts having different hole arrangements the optimum position between the fastening screws and the strip-shaped inserts cannot always be achieved. This design is also disclosed in U.S. Pat. No. 5,016,901.

The purpose of the present invention is to bring help here and to arrange the shock absorbing elements corresponding with the respective hole arrangements of the ski binding parts to be fastened.

SUMMARY OF THE INVENTION

The objects and purposes of the invention are met by providing a shock absorber for effecting a fastening of a ski binding to a ski which has an upper belt, and internal core and a lower belt, the ski binding having a base plate member adapted to be secured to the ski. An insert device is provided for reception through an opening in the upper belt and into the internal core of the ski for effecting a securement of the ski binding to the ski. The insert device includes an elongated hollow sleeve member fixedly anchored in the internal core of the ski so that a central axis thereof is oriented generally perpendicular to an upper surface of the upper belt. An end of the hollow sleeve member adjacent the upper belt is opened. The hollow sleeve member has a smooth inner wall surface defining a first cross sectional area larger than a second cross sectional area of the open end into the hollow sleeve. A high strength layer member is reciprocally received in the hollow sleeve member. The high strength layer member has a further cross sectional area conforming in size to the cross sectional area of the inside of the hollow sleeve member as well as a first part of a two part fastening device. An elastomer material member is oriented between the high strength layer member and the opened end of the hollow sleeve member so that the elastomer material member will be compressed as the high strength layer member moves toward the open end. The first part of the two part fastening device is connected to a second part to facilitate a securing of the ski binding to the ski, the connected first and second parts effectively uniting the base plate member to the high strength layer member.

BRIEF DESCRIPTION OF THE DRAWINGS

Further advantages, details and characteristics of the invention can be taken from the drawings which illustrate several exemplary embodiments. In the drawings.

Figure 6:
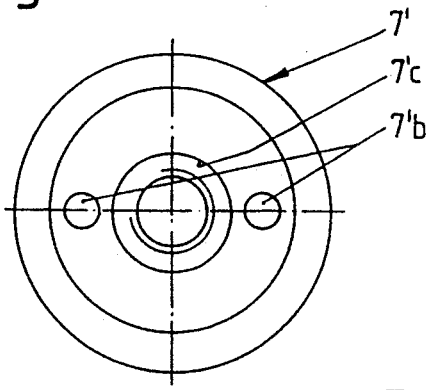

An associated top view is shown in FIG. 6.

Figure 7:
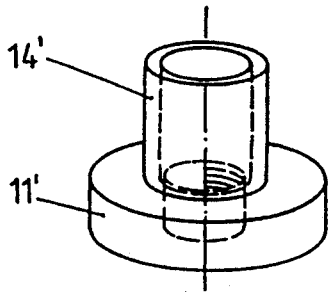
Figure 8:
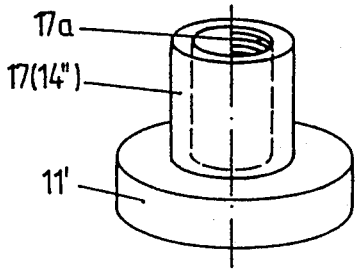
Figure 9:
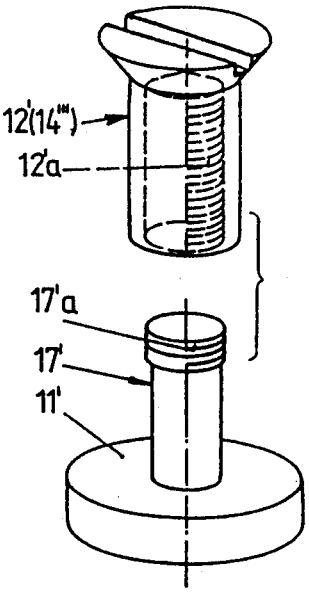

FIGS. 7–9 are perspective views of details of further modifications of the development of the invention.

Figure 10:
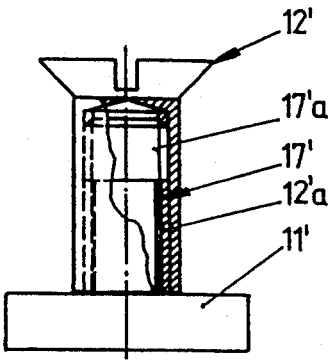

FIG. 10 is a partial cross-sectional view of the screwed embodiment according to FIG. 9.

Figure 11:
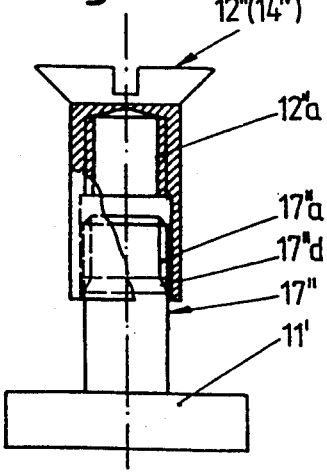

FIG. 11 shows a modification thereof.

Figure 1:
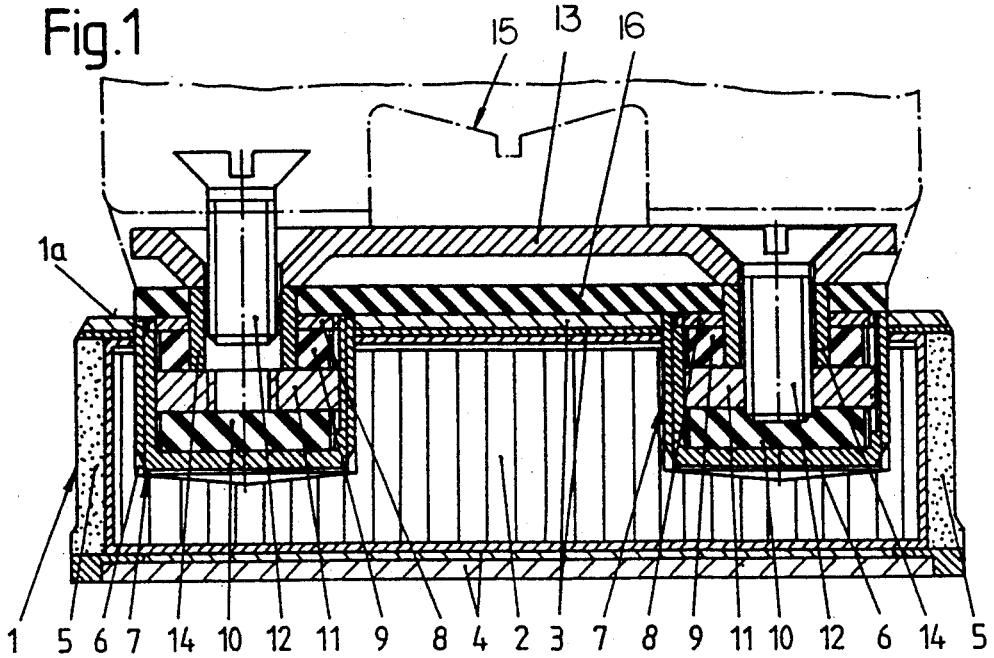
FIG. 1 is a cross-sectional view of a first embodiment of the invention.
Figure 13:
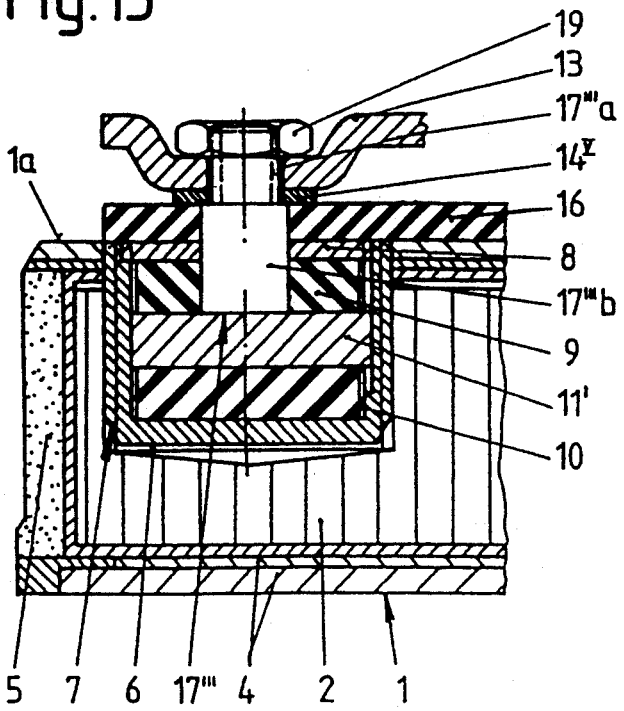
Figure 12:
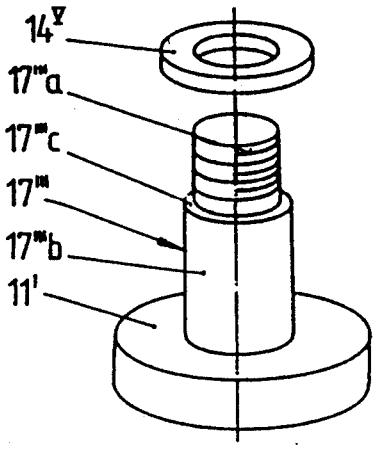
Figure 14:
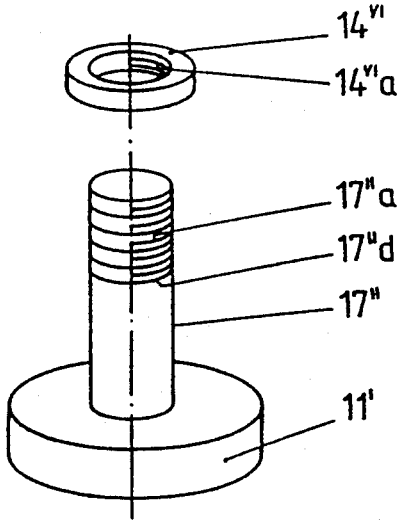

FIGS. 12 and 14 show further modifications of details in an exploded illustration, and FIG. 13 is a cross-sectional view similar to FIG. 1 in the detail according to FIG. 12.

DETAILED DESCRIPTION

A ski is identified by the reference numeral 1 in FIG. 1. It has a core 2 which is covered by an upper belt 3 on its upper side and by a lower belt 4 on its underside. Side plates 5 are attached to the narrow side surfaces of the core 2. The design of such a ski is known and is not part of the subject matter of the present invention.

Figure 2:
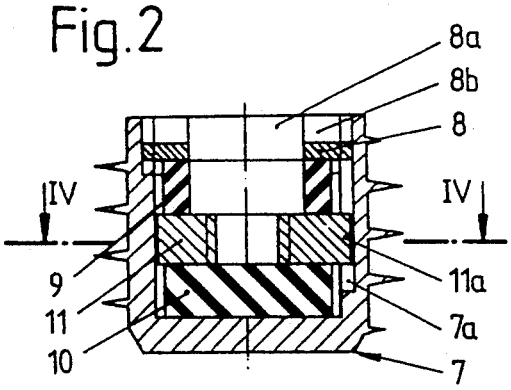
FIG. 2 is a cross-sectional view of a detail of FIG. 1 in an enlarged scale.
Figure 3:
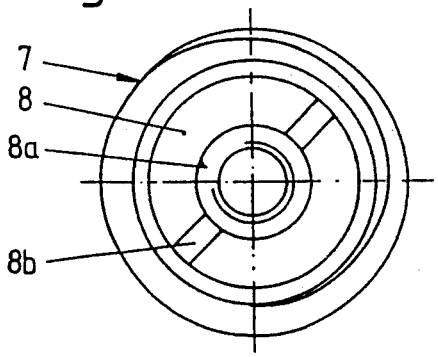
FIG. 3 is an associated top view.

Suitable bores 6, for example metallic sleeves 7, are screwed into the core 2 of the ski 1. FIGS. 1, 2 and 3 show that the upper end of the sleeve 7 is open and is fixedly connected, in the present exemplary embodiment screwed, to a lid 8. The lid 8 has, as can be recognized from FIGS. 2 and 3, a bore **8*a* to receive fastening screws, which will be described later on, and slot-like recesses 8*b*** to receive a suitable tool.

An insert 9, 10, 11 having three layers 9, 10 and 11 is provided in the cavity of each sleeve in this embodiment. The upper and the lower layer 9 and 10 are thereby manufactured each of an elastomer material with viscoelastic characteristics, as for example rubber or silicon rubber. A layer 11 of a high strength material, for example metal, is provided between these layers 9 and 10.

According to FIG. 1, a fastening screw on a base plate 13 of an indicated ski binding 15, which fastening screw is designed as a metal screw 12, is screwed to the high strength layer 11 so that the ski binding 15 is fixedly anchored to the ski 1. The metal screw 12 is guided in a spacer sleeve 14 which extends through a further elastic layer 16 on the upper side 1*a* of the ski, through the lid 8 of the sleeve 7 with clearance and through the upper elastic layer 9 in the cavity of the sleeve 7, is supported on the high strength layer 11 and projects upwardly beyond the upper side 1*a* of the ski.

Figure 4:
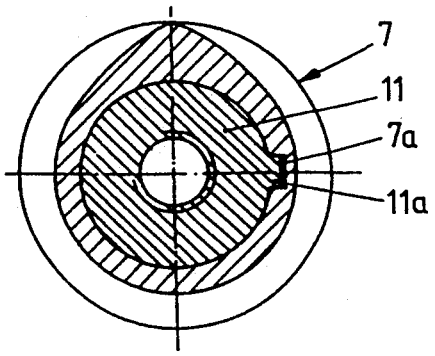
FIG. 4 is a cross-sectional view taken along the line IV—IV of FIG. 2.

FIGS. 2 and 4 show a possible measure to secure high strength layer 11 against rotation during installation. The high strength layer 11 has at least one shoulder 11*a* for this purpose, which conforms to and is received in an internal. groove 7*a* of the sleeve 7.

All illustrated elements are in the rest position in FIG. 1. However, impacts occur on slopes having mogles, which impacts are transferred onto the skier through the ski binding 15. However, these impacts are essentially absorbed by compressing the elastic layer 9, 10 in the cylindrical cavity of the sleeve 7 and the elastic layer 16 on the upper surface 1*a* of the ski.

Figure 5:
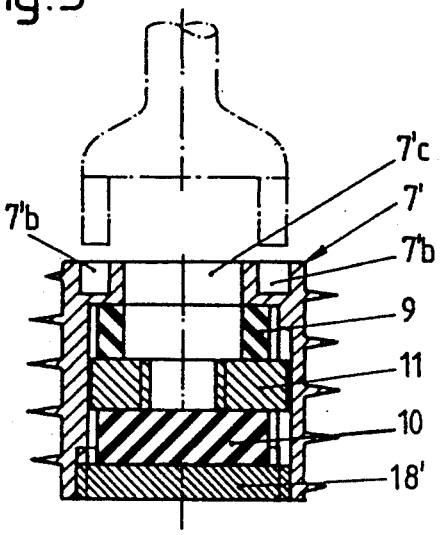
FIG. 5 is a cross-sectional view of a further embodiment of a detail similar to FIG. 2.

FIGS. 5 and 6 show a further possible design of the sleeve $7^I$. The sleeve $7^I$ is thereby open at its underside and can be closed by means of a bottom lid $18^I$ made for example of plastic. The upper side of the sleeve $7^I$ has a bore $7^Ic$ corresponding to the lid 8 of FIG. 2, and two recesses $7^Ib$ to receive a tool. The inserts and the securement against rotation are arranged also like in FIG. 2.

FIG. 7 shows a further design of the insert $11^I$ in which the spacer sleeve $14^I$ is fixedly connected, for example welded, to the insert $11^I$.

FIGS. 8, 9, 10 and 11 show embodiments in which the fastening screw constructed as a metal screw 12, $12^I$, $12^{II}$ is screwed with its thread each to a circular-cylindrically designed receiving part 17, $17^I$, $17^{II}$, which latter is fixedly connected to the high strength layer.

FIG. 8 shows accordingly the high strength layer 11 which is here fixedly connected to the circular-cylindrically designed receiving part 17, which is at the same time used as a spacer sleeve $14^{II}$. The metal screw 12 is screwed to the inside thread 17*a* of the receiving part 17.

The circular-cylindrical receiving part $17^I$, $17^I$ has an external thread $17^Ia$, $17^{II}a$ in FIGS. 9, 10 and 11, which external thread is screwed to a metal screw $12^I$, $12^{II}$ having an internal thread $12^Ia$, $12^{II}a$. The internal thread $12^Ia$ extends in the development according to FIGS. 9 and 10 over the entire cavity of the metal screw $12^I$. The receiving part 17 is thereby designed such that the diameter of its lower, thread-free section is the same as or smaller than the inside diameter of the thread 17*a*. The lower, thread-free section has in a fastening screw $12^{II}$ according to FIG. 11 a diameter which is equal to, preferably larger than, the outside diameter of the thread $12^{II}a$. The shaft of the metal screw $12^I$, $12^{II}$, forms thereby at the same time the spacer sleeve $14^{III}$, $14^{IV}$, when same is rotated during installation until it sits with its lower face on the high strength layer $11^I$.

The high strength layer $11^I$ is according to FIG. 12 fixedly connected to a cylindrically constructed receiving part $17^{III}$ having a thread $17^{III}a$. The outside diameter of the section of the receiving part $17^{III}$, which section carries the thread $17^{III}a$, is thereby less than the one of the widened shank section $17^{III}b$ lying therebelow. A spacer ring $14^V$ can now be placed onto the thus resulting shoulder on the face $17^{III}c$.

FIG. 13 illustrates the development according to FIG. 12 in a mounted state. The receiving part $17^{III}$ fixedly connected to the high strength layer $11^I$ penetrates through the upper viscoelastic layer 9, the lid 8 of the sleeve 7 with clearance, the viscoelastic layer 16 arranged onthe upper surfaces 1*a* of the ski the spacer ring $14^V$, the base plate $13^I$ of a ski binding (not illustrated) and is threadedly engaged with a nut 19. This construction provides a fixed or defined distance between the base plate 13 and the upper surface 1*a* of the ski, which distance is necessary for absorbing the shocks occurring during skiing. FIG. 14 illustrates a further embodiment of the spacer ring $14^{VI}$. The spacer ring $14^{VI}$ has thereby an internal thread $14^{VI}a$ and is screwed to the cylindrical receiving part $17^{II}$ up to its thread chamfer $17^{II}d$, thus defining the position of the spacer ring $14^{VI}$. The receiving part $17^{II}$ is also in this embodiment connected to the high strength layer $11^I$ and is screwed to a nut during installation.

All disclosed embodiments can be combined selectively with a sleeve 7 according to FIGS. 2 to 4 or a sleeve $7^I$ according to FIGS. 5 and 6.

The invention is not to be limited to the illustrated and described embodiments. Further modifications are conceivable without departing from the scope of protection. For example, the insert can be designed with more than three layers, with the designer having a free hand as needed in choosing the materials. Also the type of fastening of the individual sleeves in the body of the ski is not to be limited to screwing as a gluing thereof is also conceivable. Furthermore, it is possible to use in place of metal sleeves of a suitable plastic material or wood. Another possibility results from a multilayered design of the high strength material layer.

Other, not illustrated form-locking solutions also exist for the securement against rotation. For example, the high strength layer can be designed as a square instead of cylindrically and can cooperate with a suitably designed cavity in the sleeve.

The embodiments of the invention in which an exclusive property or privilege is claimed are defined as follows:

I claim:

1. A shock absorber for effecting a fastening of a ski binding to a ski having an upper belt, an internal core and a lower belt, said ski binding having a base plate means adapted to be secured to said ski, comprising an insert means adapted to be inserted through an opening through said upper belt and into said internal core of said ski for effecting a securement of said ski binding to said ski, said insert means including:

an elongated hollow sleeve member fixedly anchored in said internal core of said ski so that a central axis thereof is oriented generally perpendicular to an upper surface of said upper belt, an end of said hollow sleeve member adjacent said upper belt being open, said hollow sleeve member having a smooth inner wall surface defining a first cross sectional area in a first plane perpendicular to said central axis larger than a second cross sectional area of said open end of said hollow sleeve in a second plane perpendicular to said central axis;

a high strength layer member reciprocally received in said hollow sleeve member, said high strength layer member having a third cross sectional area in a third plane perpendicular to said central axis conforming in size to said first cross sectional area as well as a first part of a two part fastening means thereon; and an elastomer material member oriented between said high strength layer member and said open end of said hollow sleeve member so that said elastomer material member will be compressed as said high strength layer member moves toward said open end, said first part of said two part fastening means being connected to a second part to facilitate a securing of said ski binding to said ski, said connected first and second parts effectively uniting said base plate members to said high strength layer member.

2. The shock absorber according to claim 1, wherein said open end of said hollow sleeve is defined by a separate cover member having means defining a hole therethrough, said hole being said open end which has said second cross sectional area, said separate cover member, prior to assembly thereof to said hollow sleeve member, allowing access to said first cross sectional area of said smooth inner wall surface to facilitate insertion of said high strength layer member and said elastomer material member into the interior of said hollow sleeve member.

3. The shock absorber according to claim 2, wherein said cover member and said hollow sleeve member have operatively connectible thread means thereon for effecting a coupling of said cover member to said hollow sleeve member.

4. The shock absorber according to claim 3, wherein said cover member includes means thereon for selective connection to a hand tool.

5. The shock absorber according to claim 2, wherein an opposite end of hollow sleeve member remote from said open end is closed off by means of a bottom wall.

6. The shock absorber according to claim 5, wherein a further layer of elastomer material is oriented between said high strength layer member and said bottom wall.

7. The shock absorber according to claim 1, wherein an opposite end of hollow sleeve member remote from said open end is closed off by means of a bottom wall, wherein a further layer of elastomer material is oriented between said high strength layer member and said bottom wall, wherein said bottom wall is defined by a bottom lid separate from said hollow sleeve member, and wherein connecting means are provided for connecting said bottom lid to said hollow sleeve member, so that prior to assembly of said bottom lid to said hollow sleeve, access is provided to said first cross sectional area of said smooth inner wall surface to facilitate insertion of said high strength layer member and said elastomer material member into the interior of said hollow sleeve member.

8. The shock absorber according to claim 1, wherein said first part of said two part fastening means is defined by an internal threaded hole in said high strength layer member, said wherein said second part is an externally threaded screw operatively connected in said internally threaded hole.

9. The shock absorber according to claim 8, wherein said hollow sleeve member includes means thereon for selective connection to a hand tool.

10. The shock absorber according to claim 1, wherein said high strength layer member includes a flat plate-like member, wherein said first part of said two part fastening means is defined by an internally threaded hole in said plate-like member, and wherein said second part is an externally threaded screw operatively connected in said internally threaded hole.

11. The shock absorber according to claim 10, wherein said high strength layer member additionally includes a spacer sleeve extending between mutually facing surfaces of said base plate means and said plate-like member.

12. The shock absorber according to claim 1, wherein said high strength layer member includes a flat plate-like member and an elongated part smaller in cross section than said third cross sectional area extending axially from said plate-like member toward said base plate member, and wherein said first part of said two part fastening means is provided on said elongated part.

13. The shock absorber according to claim 12, wherein said first part is an external thread, and wherein said second part is an elongated screw having an axially extending, internally threaded hole therein for threadedly receiving therein said external thread on said elongated part.

14. The shock absorber according to claim 13, wherein said external thread has an outer diameter that is smaller in cross sectional area than a cross sectional area of said elongated part, a shoulder being defined at a juncture between said external thread and said elongated part, and wherein a spacer ring is provided on said shoulder having an axially facing surface opposing said base plate member.

15. The shock absorber according to claim 13, wherein a spacer ring is provided which has an internal threaded thereon threadedly engaged with said external thread on said elongated part.

16. The shock absorber according to claim 12, wherein said first part is an internally threaded hole extending axially through a center of said elongated part, and wherein said second part is an externally threaded screw, said externally threaded screw being threadedly received in said internally threaded hole.

17. The shock absorber according to claim 11, wherein smooth inner wall surface of said hollow sleeve member has an axially extending groove therein, and wherein said plate-like member has a shoulder therein received in said groove so that said plate-like member and said hollow sleeve member are prevented from rotating with respect to one another.

18. The shock absorber according to claim 11, wherein said base plate means includes base plate member and a layer of elastomer material between said base plate member and said upper belt of said ski.

19. The shock absorber according to claim 18, wherein said high strength layer member includes a flat plate-like member and an elongated part smaller in cross section than said third cross sectional area extending axially from said plate-like member toward said base plate member, and wherein said first part of said two part fastening means is provided on said elongated part, wherein said first part is an external thread, wherein said external thread projects through said layer of elastomer material and through an opening in said base plate member, and wherein said second part of said two part fastening means is an internally threaded nut engaged with said external thread on a side of said base plate member remote from said insert means.

20. The shock absorber according to claim 19, wherein said external thread has an outer diameter that is smaller in cross sectional area than a cross sectional area of said elongated part, a shoulder being defined at a juncture between said external thread and said elongated part, and wherein a spacer ring is provided on said shoulder having an axially facing surface opposing said base plate member, and wherein said shoulder and said spacer ring thereon are oriented adjacent a side of said layer of elastomer material remote from said insert means.

21. The shock absorber according to claim 19, wherein a spacer ring is provided which has an internal thread thereon threadedly engaged with said external thread on said elongated part.

22. The shock absorber according to claim 1, wherein said hollow sleeve member, said high strength layer member and said elastomer material member are each cylinder in construction.

* * * * *

UNITED STATES PATENT AND TRADEMARK OFFICE

CERTIFICATE OF CORRECTION

PATENT NO. : 5 207 445

DATED : May 4, 1993

INVENTOR(S) : Klaus HOELZL

It is certified that error appears in the above-identified patent and that said Letters Patent is hereby corrected as shown below:

Column 5, line 6; change "members" to ---means---.
line 50; change "internal" to ---internally---.
line 51; change "said" (first occurrence) to ---and---.
Column 6, line 24; change "threaded" to ---thread---.
Column 8, line 3; change "cylinder" to ---cylindrical---.

Signed and Sealed this

Twenty-second Day of March, 1994

*Attest:*

Bruce Lehman

BRUCE LEHMAN

*Attesting Officer*

*Commissioner of Patents and Trademarks*